United States Patent [19]

Hultgren

[11] 4,407,357

[45] Oct. 4, 1983

[54] THIN SHEET METAL HEAT EXCHANGER

[76] Inventor: Karl S. H. Hultgren, Rosengården, S-560 41 Mullsjö, Sweden

[21] Appl. No.: 220,028

[22] PCT Filed: Apr. 22, 1980

[86] PCT No.: PCT/SE80/00118

§ 371 Date: Dec. 23, 1980

§ 102(e) Date: Dec. 3, 1980

[87] PCT Pub. No.: WO80/02322

PCT Pub. Date: Oct. 30, 1980

[30] Foreign Application Priority Data

Apr. 23, 1979 [SE] Sweden ..... 79035358

[51] Int. Cl.[3] ..... F28F 3/04

[52] U.S. Cl. ..... 165/165; 165/166

[58] Field of Search ..... 165/165, 166

[56] References Cited

U.S. PATENT DOCUMENTS

| | | | |
|---|---|---|---|
| 2,019,351 | 10/1935 | Lathrop | 165/165 |
| 2,940,736 | 6/1960 | Ödman | 165/166 |
| 3,151,675 | 10/1964 | Lysholm | 165/166 |
| 3,451,474 | 6/1969 | Cox | 165/166 |
| 3,640,340 | 2/1972 | Leonard et al. | 165/166 |
| 4,254,827 | 3/1981 | Forster et al. | 165/166 |

FOREIGN PATENT DOCUMENTS

| | | | |
|---|---|---|---|
| 8002322 | 10/1980 | Sweden | 165/165 |

*Primary Examiner*—Sheldon J. Richter

*Attorney, Agent, or Firm*—Pennie & Edmonds

[57] ABSTRACT

A thin metal heat exchanger having countercurrent flow of media on opposite sides of spaced walls is disclosed. The walls are configured with ridge-depression shapes extending at an angle to the direction of flow of media on opposite sides of the plate so as to create circulation but not turbulence of the flowing media in the depressions.

12 Claims, 6 Drawing Figures

THIN SHEET METAL HEAT EXCHANGER

The present invention relates to a heat exchanger for countercurrent heat exchange between two separated flowing media, consisting of a number of slots with common separating walls of thin sheet metal, preferably aluminium sheet metal, provided with profiles which cross each other on the adjacent separating walls and form spacer means at the points of crossing.

The invention is primarily intended to solve problems of heat exchange between two gaseous media, e.g. air-/air, but it can be used to advantage for all types of heat exhange.

Heat exchangers with non-planar heat exchanger surfaces are known per se, e.g. provided with wave-shaped corrugations intended to break the boundary layer occurring during flow past the heat exchanger surfaces preventing or making more difficult the heat transfer. It has, however, been shown that this does not have any significant effect, especially as regards heat exchange between gaseous media.

It is also known to fold an endless metal sheet in 180° folds at even spacing to produce a package which, after being placed in a box and sealed at the ends, forms a heat exchanger with ducts, with every other channel opening towards one longside and every other channel opening against the opposite longside.

A heat exchanger of the type described above does not, however, provide any essential improvement in efficiency as compared with conventional heat exchangers, and as far as is known at the time of the present application there is no heat exchanger which is as highly suited for heat exchange between two gaseous media.

To improve the thermal exchange constant in heat exchange between two gaseous media which flow separated on either side of a common separating wall, the flow must be able to be affected so that boundary layers preventing heat transfer do not occur. Turbulence, however, must not be created since this results in high pressure drop at high heat exchange constants.

The purpose of the present invention is thus to achieve a heat exchanger with a significantly improved temperature efficiency in relation to previously known exchangers and which is especially well suited to heat exchange between gaseous media.

Another purpose of the invention is to achieve a heat exchanger which, with unchanged capacity, can be manufactured at much lower cost and which can be made smaller than conventional heat exchangers.

A more specific purpose of the invention is to achieve a heat exchanger which can be adapted to the desired flow rate so that a flow pattern is obtained which results in the temperature efficiency being significantly higher than in previously known heat exchangers.

This is achieved by means of the heat exchanger according to the invention, which is characterized in that its heat exchanger surfaces are formed by the two sides of the common separating walls for the two media;

that the profiles consist of a ridge and a depression and form an angle relative to the intended direction of flow through the heat exchanger, the profiles in each individual separating wall running parallel with each other with intermediate flat sheet metal portions, and that a ridge on one side of the separating wall corresponds to a depression on its other side;

that the height of the ridges above the flat sheet metal portion corresponds to half the depth of the depressions, measured from the top of one ridge to the bottom of the adjacent depression;

that the distance between the foot of the ridge and its top in the plane of the flat sheet metal portion is the same for the ridges on both sides of the separating wall, whereby the angle which the ridge forms relative to the flat sheet metal portion in the flow direction will be the same on both sides of the separating wall; and that the portion of the separating wall which extends from the top of the ridge to the bottom of the depression forms an angle with the flat sheet metal portion which is adapted in relation to the Reynolds number at which the heat exchanger is to be used, so that circulation but not turbulence occurs in the depression at said Reynolds number.

This construction of the heat exchanger produces a circulation effect in the area of the profiled depressions of the particles in the flowing media, which pass the heat exchanger surfaces 5–10 times before they continue to the next profile. This circulation effect should not be confused with the eddies which occur in turbulence. The circulation effect according to the invention results in an appreciably increased temperature effect. A comparison between heat exchangers with and without profiles according to the invention resulted in differences by a factor of 4 in thermal exchange constants, and in certain cases the difference was even greater.

According to one embodiment of the invention, the angle in the direction of flow for the incline of the separating wall between the top of one ridge and the bottom of an adjacent depression was less than or equal to 20°. The degree of efficiency decreases for angles greater than 20°, which can be a result of the fact that turbulence effects then begin to occur. At angles somewhat greater than 20°, however, good temperature efficiencies are still obtained in comparison with when heat exchanger surfaces are used which are flat or profiled in a known manner.

According to another embodiment of the invention, the angle of incline for the separating wall between the top of one ridge and the bottom of a depression is chosen so that the distance between these points in the plane of the flat sheet metal portion is approximately half to twice the distance between the foot of one ridge and its top in said plane. The ratio between these two distances has been found to be crucial for obtaining the circulation effect according to the invention and it is dependent on the Reynolds number for the flowing media.

For Reynolds numbers in the lower laminar range, i.e. 500–1000, the distance in the plane of the flat sheet metal portion between the top of the ridge and the bottom of the depression should be approximately half the distance between the foot of the ridge and its top in said plane. Within the intermediate laminar range, i.e. Re 1000–1500, the distance should be approximately the same, and within the upper laminar range, i.e. Re 1500–2000, the distance between the top of the ridge and the bottom of the depression should be one and a half to twice the distance between the foot of the ridge and its top.

According to a further embodiment of the invention, the angle between the profiles and the flow direction of the media is preferably about 5°. This results in a favourable effect on the flow in that the particles during circulation move somewhat along the depression, so that the particles will move in a helical path.

According to a further embodiment of the invention, the angle which the ridges form with the plane of the flat sheet metal portions is less than or equal to 10° in the direction of flow, so that the pressure drop will not be too great over the heat exchanger, but also to minimize the risk of turbulence at Reynolds numbers within the upper laminar range.

According to still another embodiment of the invention, the separating walls consist of a profiled endless metal sheet which has been folded in 180° folds with even spacing, or Z-shaped sheet metal members which are so profiled that the profiles on facing sides of the members cross each other in the heat exchanger.

According to a preferred embodiment of the invention, the angle in the direction of flow which the ridges form with the plane of the flat sheet metal portions is approximately 2.5°, and the angle of incline for the separating walls between the top of the ridges and the bottom of the adjacent depressions is approximately 5°, and the angle between the profiles and the flow direction of the media is 5°.

The invention is not, however, limited to said angle between the profiles and the flow direction. If this angle is instead selected to be about 90°, the profiles are made when the separating walls are manufactured, directly with the above-mentioned or other desired angles of incline which the profiles are to have in the flow direction of the media.

Further advantages and characteristics of the present invention will be evident from the detailed description below of the invention in connection with the accompanying drawings of which:

Figures 1, 2:
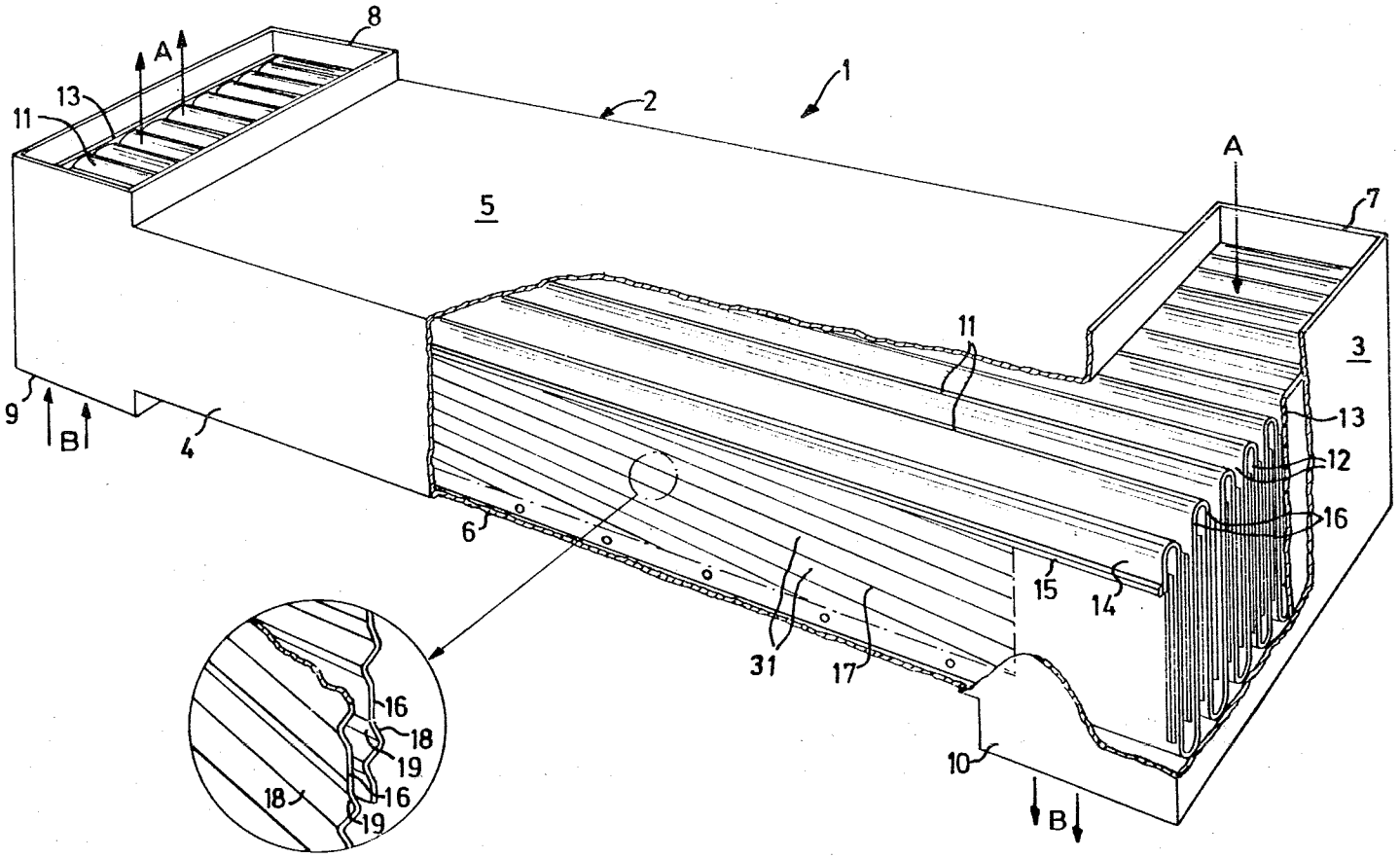
FIG. 1 is a partially cut away perspective view of the heat exchanger according to the invention.
FIG. 2 is a detail view of a cross section through two separating walls of the heat exchanger.

The heat exchanger shown in FIG. 1 is generally designated 1 and consists of a box 2 with two ends 3, two side walls 4, a cover 5 and a bottom 6. These are joined in a conventional manner by welding, and/or bolts. In the cover 5 and bottom 6, connecting pieces are arranged for the flowing media which are to be heat-exchanged with each other. In the cover 5 an inlet connection 7 and an outlet connection 8 are arranged for a first medium, the flow direction of which is shown with arrows "A". In the bottom 6, an inlet connection 9 and an outlet connection 10 are arranged for a second medium, the flow direction of which is shown with arrows "B". A folded sheet 11 is arranged in the heat exchanger box 2, said sheet forming slots 12 for the flowing media. As can be seen from the figure, every other slot is open towards the cover 5 and every other slot towards the bottom 6. Seals 13 are arranged against the ends 3, preferably by casting in a plastic composition which bakes in the edge of the sheet, thus hermetically sealing the slots 12. Sealing strips 15 of rubber or the like are arranged between the side walls 4 and the two outermost portions 14 of the sheet. No seals are required against the cover and the bottom since the same medium flows in all the slots which open towards the cover or towards the bottom.

The folded sheet 11 forms separating walls 16 which are common to the adjacent slots 12. The two surfaces of the separating walls are thus the heat exchanger surfaces of the heat exchanger. The separating walls 16 are provided with profiles 17 which are indicated with solid lines in FIG. 1.

FIG. 2 shows in an enlarged scale a cross section through two of the separating walls 16. The profiles 17 consist of a ridge 18 and a depression 19. Within each separating wall the profiles 17 run parallel with each other, while the profiles of the adjacent walls cross each other.

Figure 3:
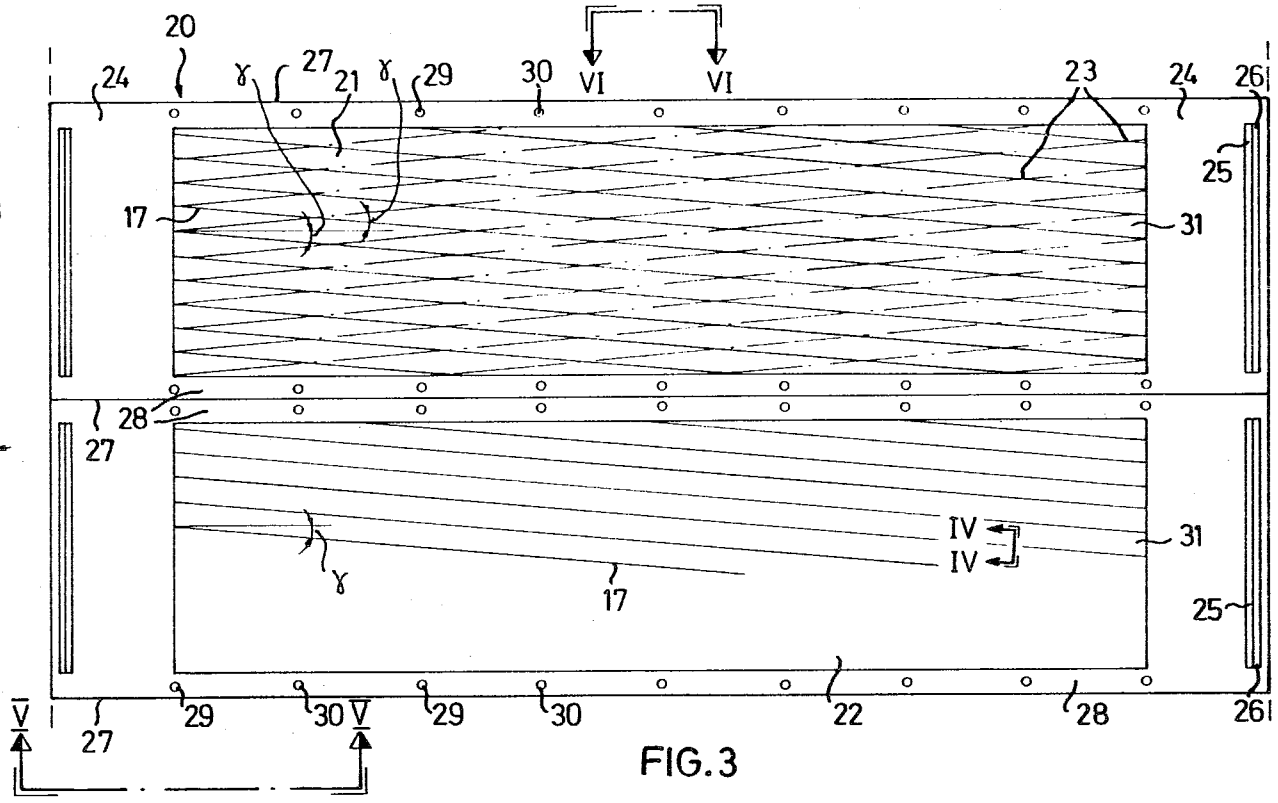
FIG. 3 is a schematic view of two separating walls before folding.

FIG. 3 shows a metal sheet 20 which has still not been folded, with two profiled heat exchanger surfaces 21 and 22. When manufacturing the heat exchanger a metal sheet is profiled, the length of which is limited by the tool used. The profiled sheets are then joined together to the required length by folding, for example. As can be seen from FIG. 3, the profiles 17 run parallel to each other at an angle $\gamma$ in relation to the transverse direction of the sheet, i.e. in relation to what is to be the longside of the separating walls. After folding, the profiles will cross each other and make contact at the crossing points 23.

The profiles do not run all the way out to the edges of the sheet, but a flat sheet portion 24 is left at each edge. These flat sheet portions 24 form inlet boxes for the flowing media, resulting in a more even inflow and distribution over the cross section of the slots 12. At the edges of the first sheet portions 24, long indentations 25 and raised portions 26 are arranged, which have the same height or depth as the ridges of the profiles and after folding will be in contact with each other on the adjacent walls.

The profiles 17 do not either extend all the way to the line 27 along which the metal sheet is to be folded, but flat sheet portions 28 provided with cylindrical indentations 29 and raised portions 30 are left there. After folding, these indentations and raised portions as well will be in contact with each other on the adjacent walls.

The indentations 25,29 and raised portions 26,30 will, together with the profiles 17 at the cross points 23, form a large number of spacer means so that the separating walls 16 will remain essentially unaffected even under large pressure loads. The main objective hereby is to avoid deformation of the profiles at the cross points.

Between the profiles 17 there are flat sheet portions 31. Their width depends of the maximum allowable pressure drop over the heat exchanger. The more closely the profiles are spaced, the higher the pressure drop over the heat exchanger. It is normally suitable to arrange these flat sheet portions with approximately the same width as the profiles.

Figure 4:
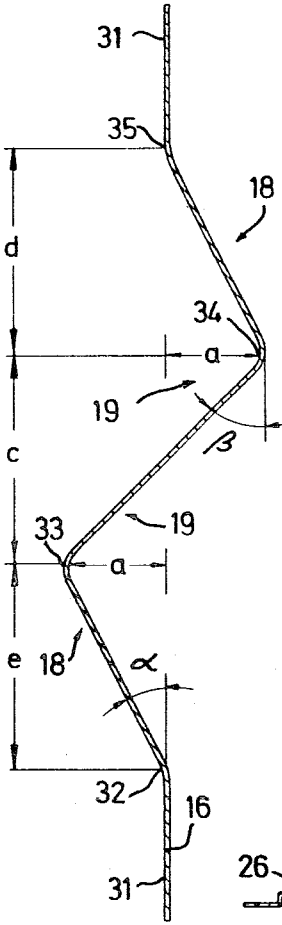
FIG. 4 is a cross section along the line IV—IV in FIG. 3 showing a profile according to the invention.

FIG. 4 shows a cross section through a profile 17 along the line IV—IV in FIG. 3. In the profile shown, a first medium is intended to flow from the left to the right in the figure above the separating wall, while a second medium is intended to flow in the opposite direction beneath the separating wall.

The profile 17 thus consists of a ridge 18 and a depression 19. From the foot 32 of the ridge to its top 33, the separating wall 16 is inclined as an angle $\alpha$ in relation to the plane of the flat sheet portion. From the top 33 of the ridge to the bottom of the depression, the separating wall 16 is inclined at an angle $\beta$ in relation to the plane of the flat sheet portion and from the bottom of the depression 34 to the foot 35 of the ridge formed on the wall's 16 opposite side of the depression at the angle $\alpha$ in relation to the plane of the flat sheet portion.

The height of the ridge 18 is designated "a" and when the profiles are symmetrical, the depth of the depression will be equal to twice the height. Furthermore, the distance "e" from the foot 32 of the ridge to its top 33 is equal to the distance "d" from the bottom 34 of the depression to the foot 35 of the ridge, on the opposite side of the separating wall 16. The distance "c" from the top 33 of the ridge to the bottom 34 of the depression is in a certain proportion to the distance "e" depending on the Reynolds number for which the heat exchanger is intended. This will be treated in more detail below in connection with FIG. 6. The ratio between the distances "c" and "e" are varied by changing the angle $\alpha$ in the profiling process.

The folds at the ridge and depression of the profile must of course be softly rounded and not sharp, both for reasons of strength and flow considerations.

Figure 5:
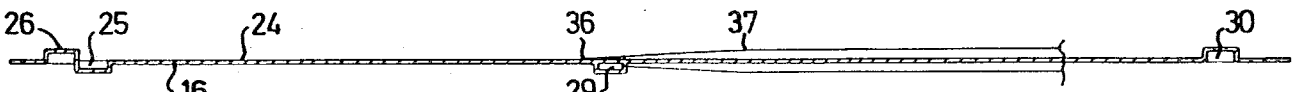
FIG. 5 is a cross section along the line V—V in FIG. 3 showing a portion of a separating wall next to an end piece; and, FIG. 6 is a cross section along the line VI—VI in FIG. 3 showing, perpendicularly to the flow direction, a profile with flow lines to illustrate the circulation effect, which gives the heat exchanger according to the invention its exceptionally high efficiency.

FIG. 5 shows a cross section along the line V—V in FIG. 3 through a portion of a separating wall 16. The indentations 25 and raised portions 26 forming the spacer means are arranged close to the outer edge of the flat sheet portion 24. The cylindrical indentations 29 and raised portions 30 are arranged alternating. Preferably the profiles do not begin abruptly but, as shown in the figure, gradually within the range 36–37 after which they reach full height. A similar range is disposed on the other side of the profiled sheet portions.

Figure 6:
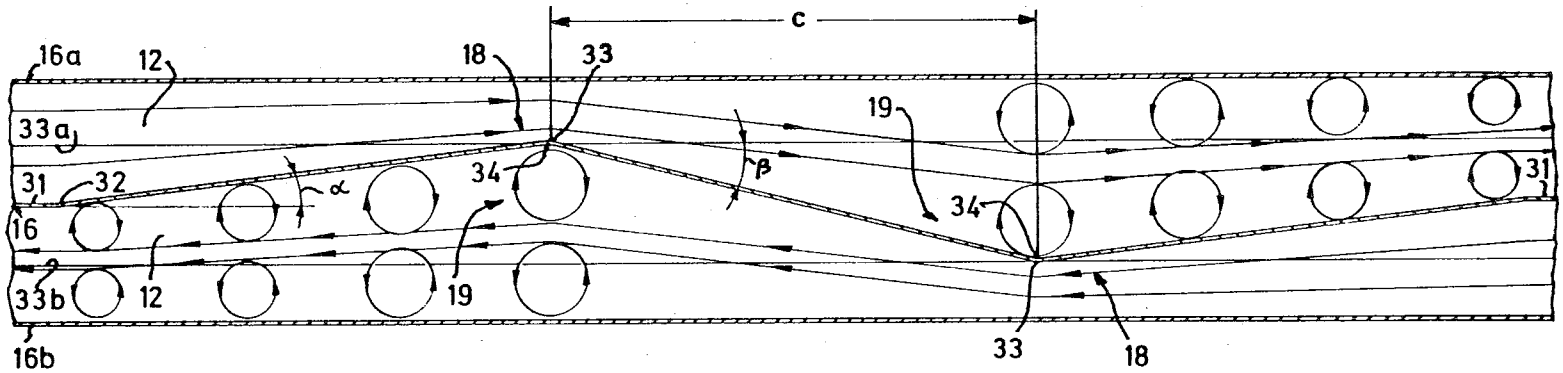

FIG. 6 shows a cross section along the line VI—VI in FIG. 3 through three separating walls 16, **16*a* and 16*b*, viewed perpendicularly to the direction of flow. Schematic flow lines illustrate the circulation effect achieved by the profiles and which provide the heat exchanger according to the invention with its high efficiency. The slot width between the flat sheet portions of the separating walls corresponds to twice the ridge height. The ridges of the separating walls 16*a* and 16*b* are indicated by solid lines 33*a* and 33*b***.

The circulation effect occurs after a transition point which lies immediately after the bottom 34 of the depression. Mathematically it can be shown that the transition point lies at a distance $9/7\times c$ from the top 33 of the ridge. To achieve maximum circulation effect, the distance "c" must be adapted to the Reynolds number in question. Within the lower laminar range, i.e. for Re 500–1000, "c" should be about equal to half the distance "e" between the foot 32 of the ridge and its top 33. Within the intermediate laminar range "c" should be about equal to "e", and within the upper laminar range "c" should be about 1.5–2 times "e".

As the flow lines in the figure indicate, the circulation effect results in each media particle coming into contact with the heat exchanger surfaces a number of times due to circulation, which improves the thermal exchange constant for the heat exchanger many times over. This circulation should not be confused with the turbulent eddies which occur at Reynolds numbers above about 2000. The flow is laminar even within the narrowest section, i.e. at the top 33 of the ridge, while the speed at the transition point is substantially lower. Actually, here both a positive and a negative flow speed are obtained, which results in circulation. This circulation is directed towards both of the adjacent surfaces from a main flow portion midway between the heat exchanger surfaces, cf. the flow lines in the figure.

Thus a maximum circulation effect can be obtained at a desired Reynolds number by varying the distance "c" according to the above.

Irregularities in the flow occur past the points where the profiles cross each other. This does not, however, affect the efficiency of the heat exchanger to any appreciable degree.

Due to the fact that the profiles 17 are obliquely arranged in relation to the flow direction, cf. angle $\gamma$ in FIG. 3, a certain movement along the depression occurs, so that the particles can be said to move helically.

The angle of incline $\alpha$ for the separating wall 16 between the foot 32 of the ridge and its top 33 should not exceed about 10° in the direction of flow. It is true that the effect is still present above this value as well, but the results are poorer due to the powerful directional changes which the flowing medium is subjected to. An angle $\alpha$ of about 5° is preferred.

The angle of incline $\beta$ for the separating wall 16 between the top 33 of the ridge and the bottom 34 of the depression should not exceed 20°. Its size depends on the desired length of the distance "c" between these two points.

To further illustrate the invention, the following are the results of a test conducted with a prototype heat exchanger in which the distance between the centres of the profiles was 25 mm, the gap width was 3.45 mm, the hydraulic diameter was $6.06\times10^{-3}$ mm, the number of slots for each medium was 41 and the total heat surface was 20.5 $m^2$.

The theoretical k-value, $k_t$, was calculated from Nusselt's equation, while the actual k-value, $k_v$, was calculated with the aid of the formula $Q=k_v\times20.5\times\nu$, where Q is the energy flow and $\nu$ is the mean temperature difference. The k-values apply at a section before a profile for the exhaust air and consequently after a profile for the fresh air. During the test the Re number was about 800–1250, i.e. clearly within the laminar range.

TABLE

| | Exhaust air | | | Fresh air | | | Temperature efficiency | | | |
|---|---|---|---|---|---|---|---|---|---|---|
| Trial | $t_{in}$ | $t_{out}$ | t | $t_{in}$ | $t_{out}$ | t | | $k_t$ | $k_v$ | $k_v/k_t$ |
| 1 | 23.5 | 13.5 | 10.0 | 11.5 | 23.1 | 11.6 | 0.900 | 6.8 | 35.8 | 5.26 |
| 2 | 24 | 12 | 12 | 11.6 | 23.5 | 11.9 | 0.964 | 7.8 | 94.4 | 12.1 |
| 3 | 24.2 | 14 | 10.2 | 13.5 | 23.5 | 20 | 0.94 | 7.4 | 90.3 | 12.2 |
| 4 | 24.5 | 14.8 | 9.7 | 14 | 24 | 10 | 0.94 | 7.3 | 53.7 | 7.36 |
| 5 | 25.3 | 15.5 | 9.8 | 15 | 23.9 | 8.9 | 0.91 | 7.4 | 39.9 | 5.39 |
| 6 | 25 | 15.6 | 9.4 | 15.1 | 24.4 | 9.3 | 0.94 | 7.5 | 60.5 | 8.07 |
| 7 | 26 | 16.3 | 9.7 | 15.9 | 25.6 | 9.7 | 0.96 | 6.85 | 77.3 | 11.28 |

TABLE-continued

| Trial | Exhaust air $t_{in}$ | Exhaust air $t_{out}$ | Exhaust air t | Fresh air $t_{in}$ | Fresh air $t_{out}$ | Fresh air t | Temperature efficiency | $k_t$ | $k_v$ | $k_v/k_t$ |
|---|---|---|---|---|---|---|---|---|---|---|
| | | | | | | | | mean value | | 8.81 |

As can be seen from the table, the mean value for the ratio $k_v/k_t$ was greater than 8. This is a very surprising result which demonstrates that the heat exchanger according to the invention is quite effective and usable.

In the prototype heat exchanger, the width of the profiles measured perpendicular to their longitudinal direction is 10.5 mm. For flow within the intermediate laminar range the distances "c", "d" and "e" were all equal to 3.5 mm. Due to the fact that the profiles form an angle $\gamma$ of 5° with the flow direction, the profile will have the appearance shown in FIG. 6 where the angle $\alpha$ is approximately equal to 2.5° and the angle $\beta$ is approximately equal to 5°.

By virtue of the high degree of efficiency, as demonstrated by the above test results, the heat exchanger can be made say 4 times smaller than corresponding conventional heat exchangers and still produce corresponding temperature effects. By virtue of the fact that the heat exchanger according to the invention can also be manufactured with relatively simple tools and be mass produced on an assembly line, the production cost makes the heat exchanger particularly well suited for use in dwellings, for example. It can also be used for heat exchange between liquid media such as water, and between gas and liquid, making the range of use virtually unlimited.

I claim:

1. Heat exchanger for countercurrent heat exchange between two separated flowing media, consisting of a number of slots with common separating walls of thin sheet metal, preferably aluminium sheet metal, provided with profiles which cross each other on adjacent separating walls and form spacer means at the crossing points, characterized in that its heat exchanger surfaces are formed by the two sides of the separating walls (16) common to the two media, that the profiles consist of a ridge (18) and a depression (19) and are arranged at an angle ($\gamma$) in relation to the intended direction of flow through the heat exchanger, the profiles (17) on each individual separating wall (16) running parallel with each other with intermediate flat sheet metal portions (31), and that a ridge on one side of the separating wall corresponds to a depression on its other side, the the height (a) of the ridges (18) above the flat sheet metal portions (31) corresponds to half the depth of the depressions (19), measured from the top of one ridge to the bottom of the adjacent depression, that the distance (e) between the foot (32) of the ridge and its top (33) in the plane of the flat sheet metal portion (31) is the same for the ridges on both sides of the separating wall, whereby the angle ($\alpha$), which the ridge forms with the flat sheet metal portion in the flow direction, will be the same on both sides of the separating wall, and that the portion of the separating wall which extends from the top (33) of the ridge to the bottom (34) of the depression forms an angle ($\beta$) with the flat sheet metal portion (31) in the flow direction which is adapted in relation to the Reynolds number at which the heat exchanger is to be used, so that circulation but not turbulence occurs in the depression at said Reynolds number.

2. Heat exchanger according to claim 1, characterized in that the separating wall (16) between the top (33) of a ridge (18) and the bottom (34) of the adjacent depression (19) is inclined in relation to the flat sheet metal portion (31) at an angle ($\beta$) which is smaller than or equal to 20° in the direction of flow.

3. Heat exchanger according to claim 1, characterized in that the angle of incline ($\beta$) of the separating wall (16) between the top (33) of the ridge and the bottom (34) of the depression is selected so that the distance (c) between these points in the plane of the flat sheet metal portion is approximately half to twice the distance (e) between the foot of a ridge and its top in said plane.

4. Heat exchanger according to claim 3, characterized in that for Reynolds numbers of 500–1000 the distance (c) between the top (33) of the ridge and the bottom (34) of the depression in the plane of the flat sheet metal portion is approximately half the distance (e) between the foot (32) of the ridge and its top (33) in said plane.

5. Heat exchanger according to claim 3, characterized in that for Reynolds numbers of 1000–1500 the distance (c) between the top (33) of the ridge and the bottom (34) of the depression in the plane of the flat sheet metal portion is approximately equal to the distance (e) between the foot of the ridge and its top in said plane.

6. Heat exchanger according to claim 3, characterized in that for Reynolds numbers of 1500–2000 the distance (c) between the top (33) of the ridge and the bottom (34) of the depression is approximately 1.5–2 times the distance (e) between the foot (32) of the ridge and its top (33) in said plane.

7. Heat exchanger according to claim 1, characterized in that the separation wall (16) from the foot (32) of the ridge to any one of its top (33) forms an angle ($\alpha$) with the flat sheet metal portion (31) which is smaller than or equal to about 10°.

8. Heat exchanger according to claims 1-6 or 7, characterized in that the separating walls (16) consist of a profiled endless metal sheet which has been folded in 180° folds with even spacing.

9. Heat exchanger according to any one of claims 1-6 or 7, characterized in that the angle ($\gamma$) between the profiles (17) and the direction of flow is approximately 5°.

10. A counter-current heat exchanger, with separated flowing media, comprising a body with heat carrying media inlet and outlet connections and a heat exchanging surface in the shape of a folded thin sheet metal, said sheet being folded in 180° folds with the adjacent sheets defining separating walls forming media flow channels therebetween and having inclined parallel corrugations characterized in that the corrugations cross each other on adjacent separating walls at an angle to the direction of flow of media through said channels and are grouped in ridge-depression pairs separated by intermediate flat surfaces, the distance (c) between the top (33) of the ridge (18) and the bottom (34) of the depression (19), as measured in the plane of the flat surface (31), being equal in each pair and half to twice the distance (e) between the foot (32) of the ridge (18) and its top (33), and that the walls of corrugations between tops and intermediate flat surfaces are arranged at angle angle ($\alpha$) of not more than 10° to said flat surfaces in the direction of flow of media through said channels.

11. A heat exchanger according to claim 10, characterized in that walls of the corrugations between the tops and bottoms (33, 34) in each pair is arranged at an angle ($\beta$) not more than 20° relative to the plane of the flat surfaces in the direction of said flow of media.

12. A heat exchanger according to either of claims 10 and 11, characterized in that the angle ($\gamma$) between the corrugations and the direction of said flow is approximately 5°.

* * * * *